United States Patent [19]

Cohen

[11] 4,101,155

[45] Jul. 18, 1978

[54] DEVICE FOR PREVENTING UNINTENDED UNLOCKING OF AUTOMOBILE CAR DOORS

[76] Inventor: Nathan Cohen, 89 Bradly St., North Haven, Conn. 06473

[21] Appl. No.: 779,144

[22] Filed: Mar. 18, 1977

[51] Int. Cl.[2] ..... E05C 19/00

[52] U.S. Cl. ..... 292/347; 292/288; 292/DIG. 2

[58] Field of Search ..... 292/DIG. 2, 1, 347, 292/288; 70/181, 429; 24/213 B, 230 R

[56] References Cited

U.S. PATENT DOCUMENTS

| | | | |
|---|---|---|---|
| 1,997,756 | 4/1935 | Stamy | 24/213 B |
| 2,146,090 | 2/1939 | O'Rourke | 49/462 X |
| 2,537,380 | 1/1951 | Travis | 292/288 |
| 2,694,917 | 11/1954 | Trammell, Jr. | 292/DIG. 2 |
| 2,793,064 | 5/1957 | Budoff | 292/347 X |

*Primary Examiner*—Richard E. Moore
*Attorney, Agent, or Firm*—Roy L. Parsell

[57] ABSTRACT

A hood-like device detachably attached to the window ledge of the door inside the car which conceals the locking handle protruding through the window ledge and prevents unintended unlocking of the car door.

4 Claims, 4 Drawing Figures

16
15
10
13
11
12
17
17a
14

DEVICE FOR PREVENTING UNINTENDED UNLOCKING OF AUTOMOBILE CAR DOORS

FIELD OF THE INVENTION

The device is applicable to automobile car doors equipped with a protruding locking handle which double locks the car door and thus prevents access to the locking handle as long as the device is in place with the locking handle in locked position.

SUMMARY OF THE INVENTION

The device comprises a demountable hood mounted on the door by a resilient spring means which hood conceals and thus prevents operation of the double locking member with which the car door is usually equipped.

DESCRIPTION OF THE PREFERRED EMBODIMENT

Figure 1:
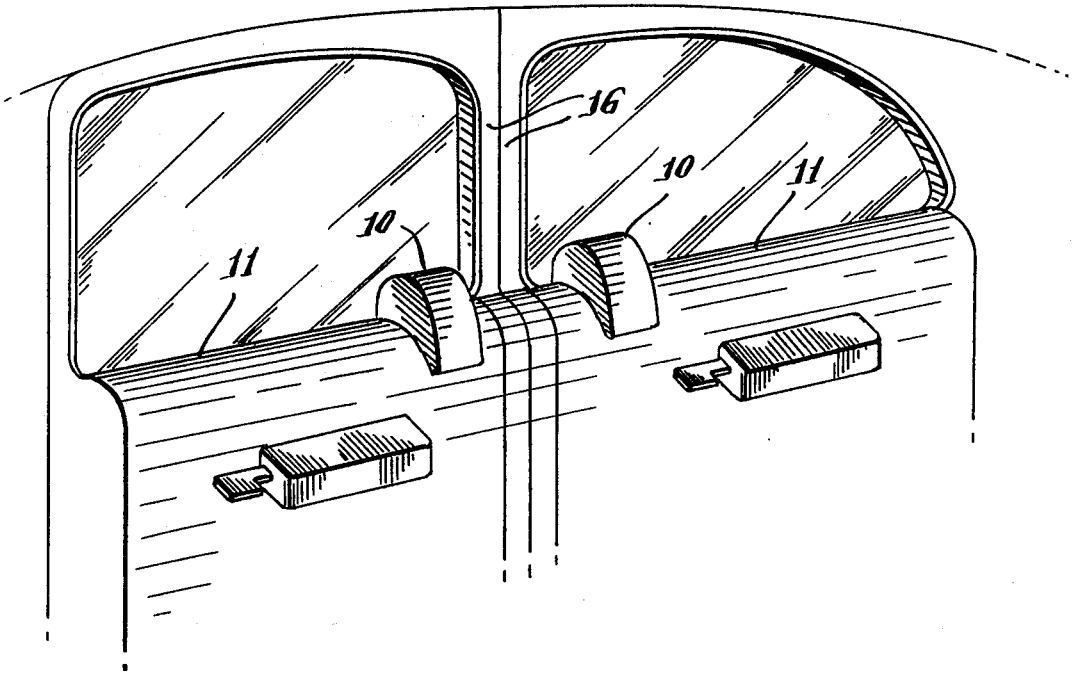
FIG. 1 is a perspective elevation of the inside of a car door showing the hood in operating position.
Figure 2:
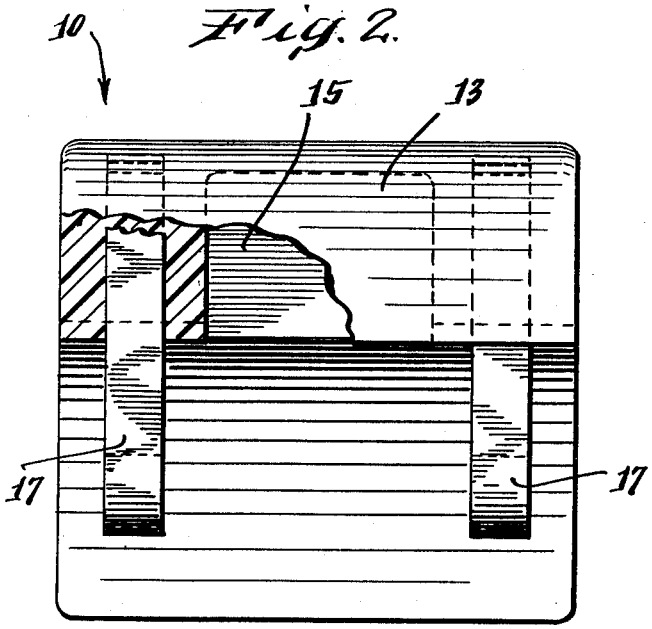
FIG. 2 is a view of the hood partly in section looking outwardly from the inside of the car.
Figure 4:
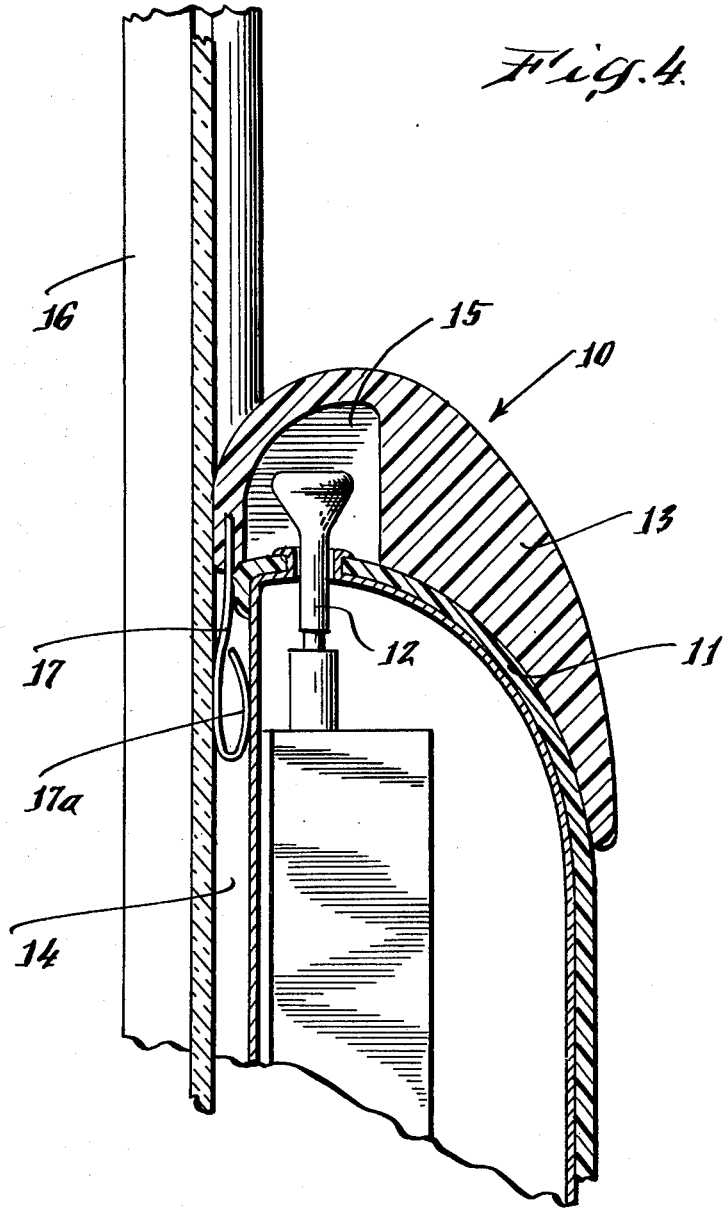
FIG. 4 is a vertical cross section of the invention installed on a car door somewhat enlarged and in operating position.

Referring to FIG. 1 and FIG. 4, the device 10 is shown applied to the inside of a car door reposing on the window ledge or that portion of the door corresponding thereto and depending downwardly along the inside of the door to conceal and prevent access to the door lock operating member 12. In this position and with the window closed, the door cannot be opened either from the outside or the inside thus affording protection from unauthorized persons desiring to enter the car or the occupants, as for example children, opening the car door and possibly falling out.

The device 10 comprises essentially a hood portion 13 contoured to the inside surface of the car door and window ledge 11 and having an interior space to receive and thus conceal the door lock operating member 12 so as to prevent operation of the latter as shown most clearly in FIG. 4.

The hood 13 per se may also be a solid body provided with a cavity 15 or recessed portion which receives the top end 12*a* of the door lock operating member 12.

Figure 3:
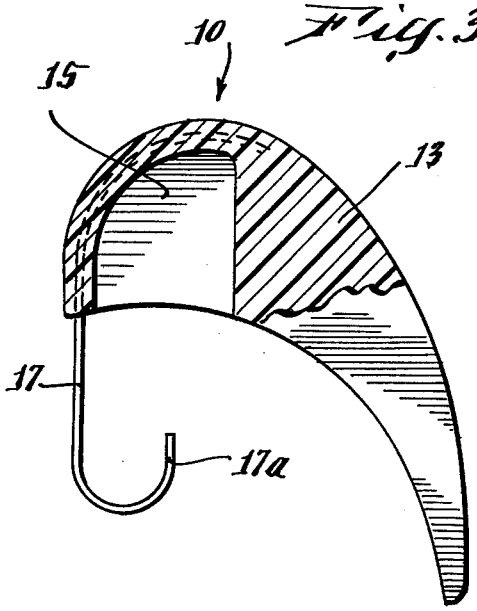
FIG. 3 is a sectional view on line 3—3 of FIG. 2.

As shown in FIG. 3 and FIG. 4 a resilient clamp arm 17 is fixedly mounted in the hood 13 or fixed thereto by any suitable means, which arm 17 extends downwardly into the space 14 between the sliding glass window 15 and the inside surface of the door wall 16. For easy installation and removal into and out of the inside of the door or window well, the respective resilient clamp arm 17 may be turned back on itself as shown in FIG. 4 in order to provide the necessary friction between the inside wall of the door and the surface of the glass window 18 whereby to removably hold the hood in place.

As an alternative structure (not shown), the hood may be formed of sheet material so that in such case the interior of the hood will be open space and thus correspond to the cavity 14 as shown for example in FIG. 4.

Having described my invention I claim:

1. In an automobile door equipped with a door lock operating member protruding through the window ledge of the door, a device removably attachable to the window ledge on the inside of the door to prevent access to the door lock operating member comprising (a) a hood removably disposed on the door at the window ledge to conceal the door lock operating member and prevent access thereto for purposes of locking or unlocking the automobile door;

(b) an elongated anchoring member fixedly mounted on the hood and extendable into the interior of the door to anchor the hood to the door; and (c) the anchoring member provided with biasing means to press against an interior wall of the door with sufficient force to substantially retard ordinary removal of the hood from the window ledge.

2. The device according to claim 4 wherein the hood is formed in a solid mass with a recess provided to receive the door lock operating member protruding from the door.

3. The device according to claim 1 wherein the hood is a hollow body having sufficiently rigid exterior walls to prevent the seizing of the lock operating member from outside the hood and to moving the lock operating member as to unlock the automobile door.

4. The device according to claim 1 wherein the outside surface of the hood is continuous and without indentation or projection whereby its removal from the door by means of an instrument inserted through a slightly opened door window is prevented.

* * * * *